US006283090B1

(12) United States Patent
Harmon

(10) Patent No.: US 6,283,090 B1
(45) Date of Patent: Sep. 4, 2001

(54) METHOD AND APPARATUS FOR OPERATING A HYDRAULICALLY-POWERED COMPRESSION RELEASE BRAKE ASSEMBLY ON INTERNAL COMBUSTION ENGINE

(75) Inventor: Michael P. Harmon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/441,854

(22) Filed: Nov. 17, 1999

(51) Int. Cl.[7] ..... F02D 13/04
(52) U.S. Cl. ..... 123/321; 123/446; 123/90.16
(58) Field of Search ..... 123/321, 322, 123/90.16, 446

(56) References Cited

U.S. PATENT DOCUMENTS

| | | | | |
|---|---|---|---|---|
| 4,572,114 | | 2/1986 | Sickler . | |
| 4,836,162 | * | 6/1989 | Melde-Tuczai et al. | 123/90.16 |
| 5,012,778 | | 5/1991 | Pitzi . | |
| 5,191,867 | * | 3/1993 | Glassey | 123/446 |
| 5,462,025 | | 10/1995 | Israel et al. . | |
| 5,479,890 | | 1/1996 | Hu et al. . | |
| 5,511,460 | | 4/1996 | Custer . | |
| 5,537,975 | | 7/1996 | Cosma et al. . | |
| 5,537,976 | | 7/1996 | Hu . | |
| 5,564,386 | | 10/1996 | Korte et al. . | |
| 5,619,964 | | 4/1997 | Feucht . | |
| 5,619,965 | | 4/1997 | Cosma et al. . | |
| 5,645,031 | | 7/1997 | Meneely . | |
| 5,730,102 | | 3/1998 | Arnold et al. . | |
| 5,735,242 | | 4/1998 | Kahlenbeck et al. . | |
| 5,794,590 | * | 8/1998 | Bergmann | 123/321 |
| 5,809,952 | * | 9/1998 | Ono et al. | 123/321 |
| 5,894,830 | * | 4/1999 | Blass et al. | 123/446 |
| 6,085,705 | * | 7/2000 | Vorih | 123/321 |
| 6,125,828 | * | 10/2000 | Hu | 123/321 |
| 6,152,104 | * | 11/2000 | Vorih et al. | 123/321 |

* cited by examiner

*Primary Examiner*—Erick Solis
(74) *Attorney, Agent, or Firm*—Maginot, Addison & Moore

(57) ABSTRACT

A method of operating an internal combustion engine having a hydraulic supply circuit, a hydraulically-powered fuel injector assembly, and a hydraulically-powered compression release brake assembly includes the step of advancing a pressurized hydraulic fluid to the fuel injector assembly from the hydraulic supply circuit so as to cause fuel to be injected into a cylinder associated with the engine when the engine is being operated in a drive mode of operation. The method also includes the step of advancing the pressurized hydraulic fluid to the compression release brake assembly so as to cause a piston to be moved from a retracted position to an extended position when the engine is being operated in a brake mode of operation. Yet further, the method includes the step of rotating a rocker arm about a rocker arm shaft so as to cause the rocker arm to contact an exhaust valve thereby urging the exhaust valve into an open exhaust valve position in response to movement of the piston from the retracted position to the extended position. An internal combustion engine is also disclosed.

16 Claims, 5 Drawing Sheets

METHOD AND APPARATUS FOR OPERATING A HYDRAULICALLY-POWERED COMPRESSION RELEASE BRAKE ASSEMBLY ON INTERNAL COMBUSTION ENGINE

TECHNICAL FIELD OF THE INVENTION

The present invention relates generally to an internal combustion engine, and more particularly to a method and apparatus for operating a hydraulically-powered compression release brake assembly of an internal combustion engine.

BACKGROUND OF THE INVENTION

Engine retarding devices of the compression release type are commonly utilized in work machines such as on-highway trucks and the like. A compression release brake assembly utilizes compression within the truck's engine to assist the truck's main braking system in order to slow the truck. In effect, such compression release brake assemblies convert the truck's internal combustion engine into an air compressor in order to develop retarding horsepower which is utilized to assist in slowing the truck.

Compression release brake assemblies which have heretofore been designed typically include a hydraulic system having a master cylinder having a piston which is actuated by a cam lobe or push rod associated with an exhaust valve, intake valve, or fuel injector corresponding to a first engine cylinder. Actuation of the piston associated with the master cylinder controls actuation of a piston associated with a slave cylinder which selectively opens and closes an exhaust valve near the end of the compression stroke thereby causing the mechanical work performed during the compression stroke to be dissipated and hence not "recovered" during the subsequent power stroke. It should be appreciated that the exhaust valve opened by the slave cylinder may be associated with either the first engine cylinder, or may alternatively be the exhaust valve associated with a second, different engine cylinder.

However, such heretofore designed compression release brake assemblies have a number of drawbacks associated therewith. For example, such heretofore designed compression release brake assemblies are relatively mechanically complex and often require a relatively large number of repairs during the useful life of the engine. In addition, such mechanical complexity generally increases the costs associated with manufacture of the engine. Yet further, such heretofore designed compression release brake assemblies typically have limited design freedoms in regard to the opening of the respective exhaust valves during braking since actuation of the respective master cylinders must be selected from a cam lobe or push rod associated with an intake valve, exhaust valve, or fuel injector which is the "closest fit" to the timing requirements of the individual exhaust valves.

In an effort to overcome the above-mention drawbacks, a number of compression release brake assemblies have been designed for use in conjunction with a hydraulically-powered fuel injection system. In such devices, the hydraulic supply system which is utilized to operate the fuel injectors of the engine is also utilized to operate the compression release brake assembly. However, such systems typically require modification to the exhaust valves in order to allow an actuator such as a hydraulic piston to contact the stem of the exhaust valve. Such modification to the exhaust valve undesirably increases costs associated with manufacture of the engine.

What is needed therefore is a method and apparatus for operating a compression release brake assembly which overcomes one or more of the abovementioned drawbacks.

DISCLOSURE OF THE INVENTION

In accordance with a first embodiment of the present invention, there is provided a method of operating an internal combustion engine having a hydraulic supply circuit, a hydraulically-powered fuel injector assembly, and a hydraulically-powered compression release brake assembly. The method includes the step of advancing a pressurized hydraulic fluid to the fuel injector assembly from the hydraulic supply circuit so as to cause fuel to be injected into a cylinder associated with the engine when the engine is being operated in a drive mode of operation. The method also includes the step of advancing the pressurized hydraulic fluid to the compression release brake assembly so as to cause a piston to be moved from a retracted position to an extended position when the engine is being operated in a brake mode of operation. Yet further, the method includes the step of rotating a rocker arm about a rocker arm shaft so as to cause the rocker arm to contact an exhaust valve thereby urging the exhaust valve into an open exhaust valve position in response to movement of the piston from the retracted position to the extended position.

In accordance with a second embodiment of the present invention, there is provided an internal combustion engine. The engine includes an engine block having a cylinder defined therein and an exhaust valve movably secured to the engine block. The engine also includes a rocker arm shaft secured to the engine block and a rocker arm rotatably coupled to rocker arm shaft. The engine further includes a hydraulically-powered fuel injector assembly secured to the engine block so as to selectively inject fuel into the cylinder. Moreover, the engine includes a hydraulically-powered compression brake assembly having a piston associated therewith. In addition, the engine includes a hydraulic supply circuit fluidly coupled to both the fuel injector assembly and the compression brake assembly. The hydraulic supply circuit is configured to advance a pressurized hydraulic fluid to the fuel injector assembly so as to cause the fuel to be injected into the cylinder when the engine is being operated in a drive mode of operation. The hydraulic circuit is further configured to advance the pressurized hydraulic fluid to the compression release brake assembly so as to cause the piston to be moved from a retracted position to an extended position when the engine is being operated in a brake mode of operation. The rocker arm is rotated about the rocker arm shaft so as to cause the rocker arm to contact the exhaust valve thereby urging the exhaust valve into an open exhaust valve position when the piston is moved from the retracted position to the extended position.

BEST MODE FOR CARRYING OUT THE INVENTION

Figure 1:
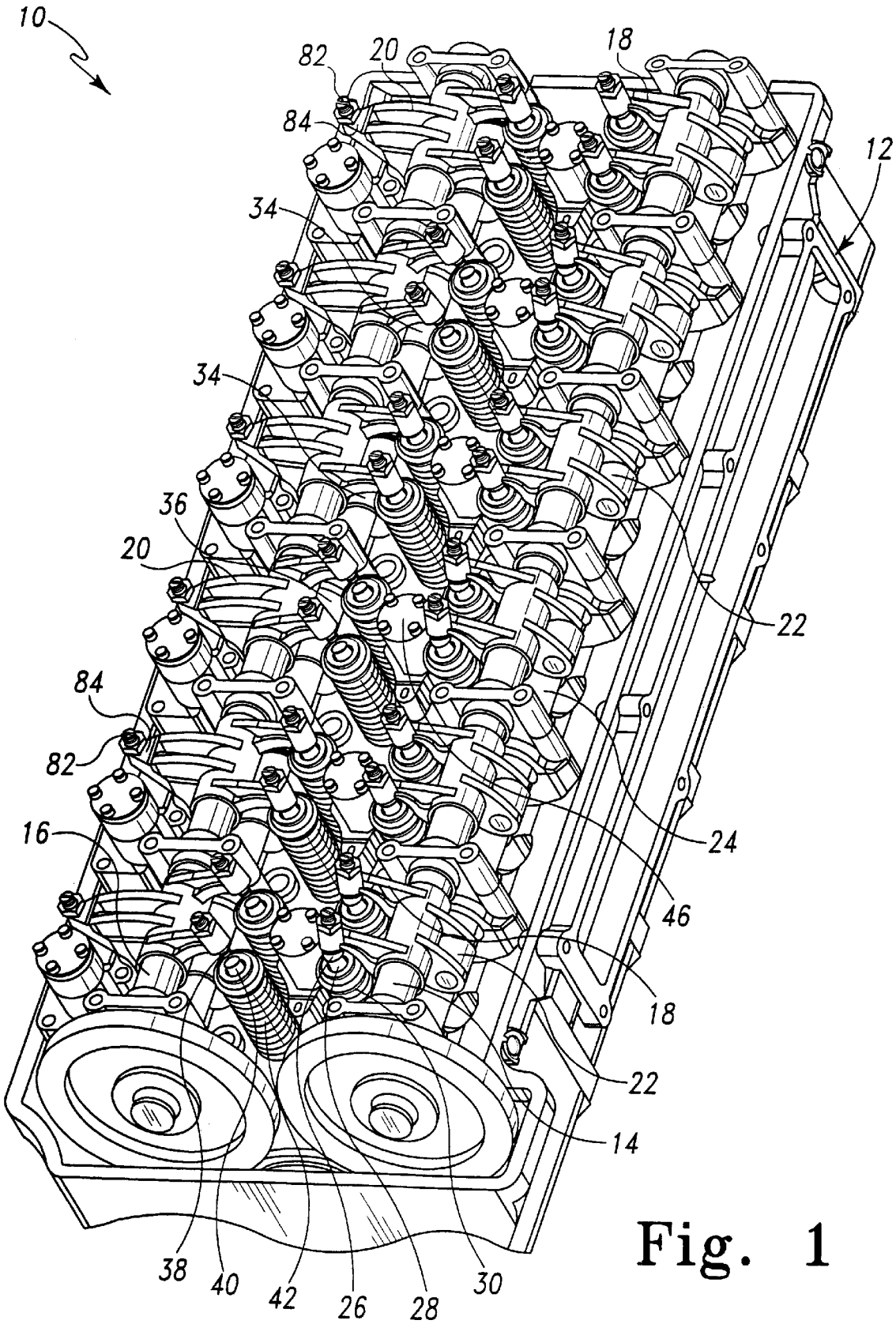
FIG. 1 is an internal combustion engine which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 2:
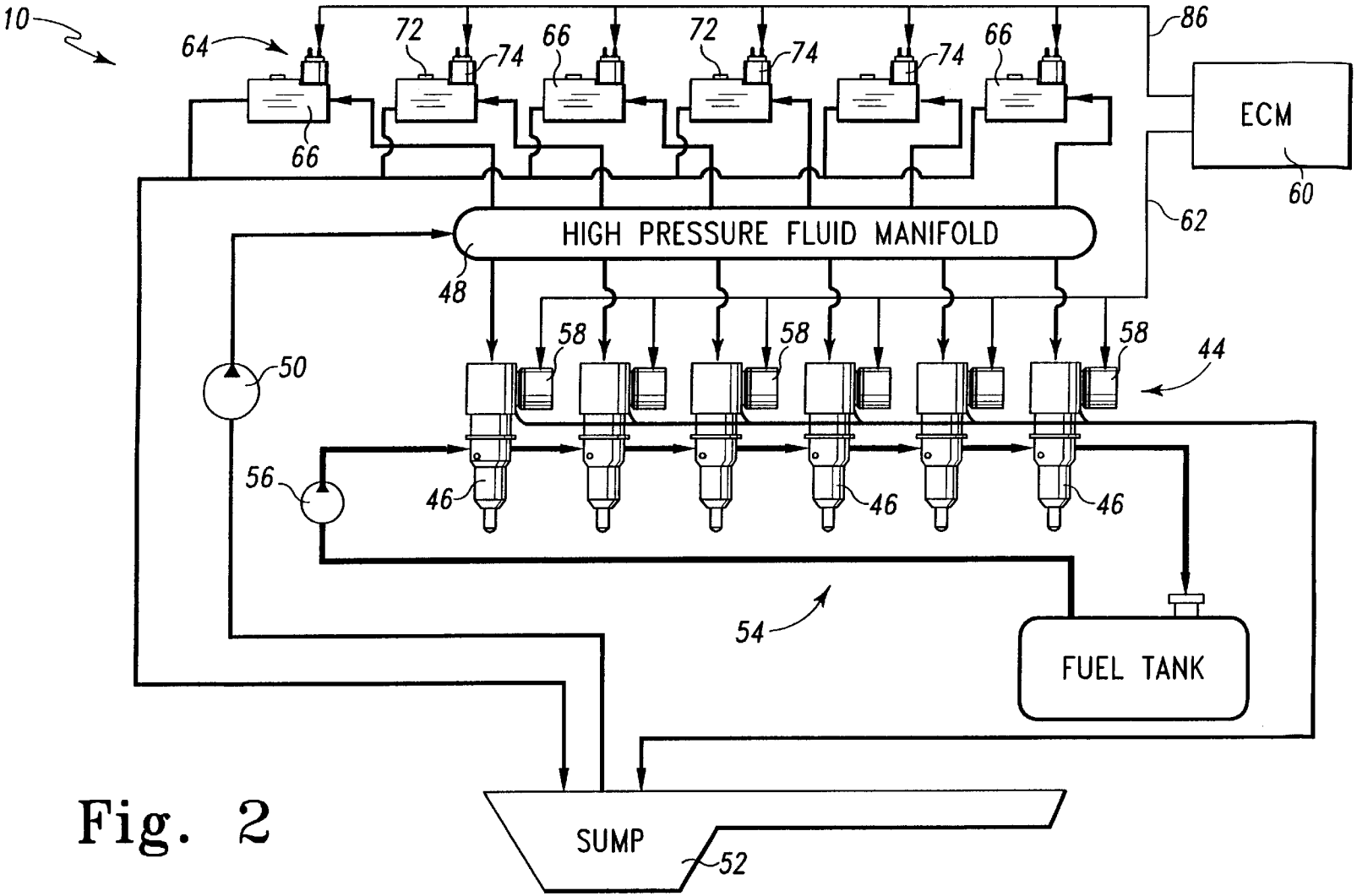
FIG. 2 is a schematic view of the internal combustion engine of FIG. 1.

Referring now to FIGS. 1 and 2, there is shown an internal combustion engine such as a diesel engine 10. The engine 10 is shown in the drawings, and will be described herein, as a six-cylinder diesel engine; however, it should be appreciated that the engine 10 of the present of invention could be embodied as any type of internal combustion engine with any number of cylinders.

The engine 10 includes an engine block and head assembly 12 having a pair of rocker arm shafts 14, 16 secured thereto. The rocker arm shaft 14 has a number of intake rocker arms 18 rotatably secured thereto, whereas the rocker arm shaft 16 has a number of exhaust rocker arms 20 rotatably secured thereto. Each of the intake rocker arms 18 has a roller 22 coupled thereto which is selectively contacted by a number of cam lobes (not shown) associated with an intake cam shaft 24. In particular, rotation of the intake cam shaft 24 causes the cam lobes associated therewith to be selectively moved into and out of contact with the rollers 22 of each of the intake rocker arms 18. Contact with one of the intake rocker arms 18 by the cam lobes causes the intake rocker arm 18 to pivot or otherwise rotate about the rocker arm shaft 14 thereby causing a valve contact rod 26 associated with the intake rocker arm 18 to contact an upper portion of a valve stem 28 of an intake valve 30. Such contact with the upper portion of the valve stem 28 urges the intake valve 30 downwardly thereby opening the intake valve 30 so as to allow air to flow into the associated engine cylinder in a known manner.

Similarly, each of the exhaust rocker arms 20 has a roller 32 (see FIG. 4) coupled thereto which is selectively contacted by a number of cam lobes 34 associated with an exhaust cam shaft 36. In particular, rotation of the exhaust cam shaft 36 causes the cam lobes 34 to be selectively moved into and out of contact with the rollers 32 of each of the exhaust rocker arms 20. Contact with one of the exhaust rocker arms 20 by the cam lobes 34 causes the exhaust rocker arm 20 to pivot or otherwise rotate about the rocker arm shaft 16 thereby causing a valve contact rod 38 associated with the exhaust rocker arm 20 to contact an upper portion of a valve stem 40 of an exhaust valve 42. Such contact with the upper portion of the valve stem 40 urges the exhaust valve 42 downwardly thereby opening the exhaust valve 42 so as to allow gas within the associated engine cylinder to flow from the cylinder.

The engine 10 also includes a hydraulically-powered fuel injection system 44. The fuel injection system 44 includes a number of fuel injectors 46 which are provided to selectively inject fuel into an associated engine cylinder. The hydraulically-powered fuel injection system 44 of the present invention may be provided as any known hydraulically-powered fuel injection system; however, one such hydraulically powered fuel injection system which is particularly useful as the hydraulically-powered fuel injection system 44 of the present invention is a Hydraulic Electronic Unit Injection (HEUI) system which is commercially available from Caterpillar, Incorporated of Peoria, Ill.

Hydraulic fluid within a hydraulic supply circuit having a fluid manifold 48 is maintained at a relatively high fluid pressure by a hydraulic pump 50. The hydraulic pump 50 is generally driven by the engine 10 and is provided to pump hydraulic fluid from a reservoir or sump 52 to the fluid manifold 48. Each of the fuel injectors 46 is fluidly coupled to the fluid manifold 48 such that fluid pressure from the manifold 48 may be utilized to generate a relatively high fuel pressure from the fuel within the fuel injectors 46. In particular, the engine 10 further includes a fuel system 54 which has a fuel pump 56 for pumping fuel to each of the fuel injectors 46. The fuel within the fuel injectors 46 is pressurized via a plunger assembly (not shown) which is driven by the fluid pressure from the fluid manifold 48.

Moreover, each of the fuel injectors 46 includes a high-speed, solenoid-actuated hydraulic valve 58 which is electrically coupled to an engine control module 60 via a wiring harness 62. In such a manner, the engine control module 60 may selectively generate injection pulses which are sent to the individual solenoid-actuated hydraulic valves 58 so as to open the valve 58 thereby increasing the fluid pressure exerted on the plunger assembly of the associated fuel injector 46 which in turn increases the fuel pressure within the injector 46. Such an increase in the fuel pressure within the fuel injector 46 causes fuel to be injected into the engine cylinder associated with the particular fuel injector 46. It should be appreciated that the engine control module 60 may operate the fuel injectors 46 in wide variety of manners in order to generate injection sequences and operation characteristics which fit the needs of a given engine 10.

Figure 3:
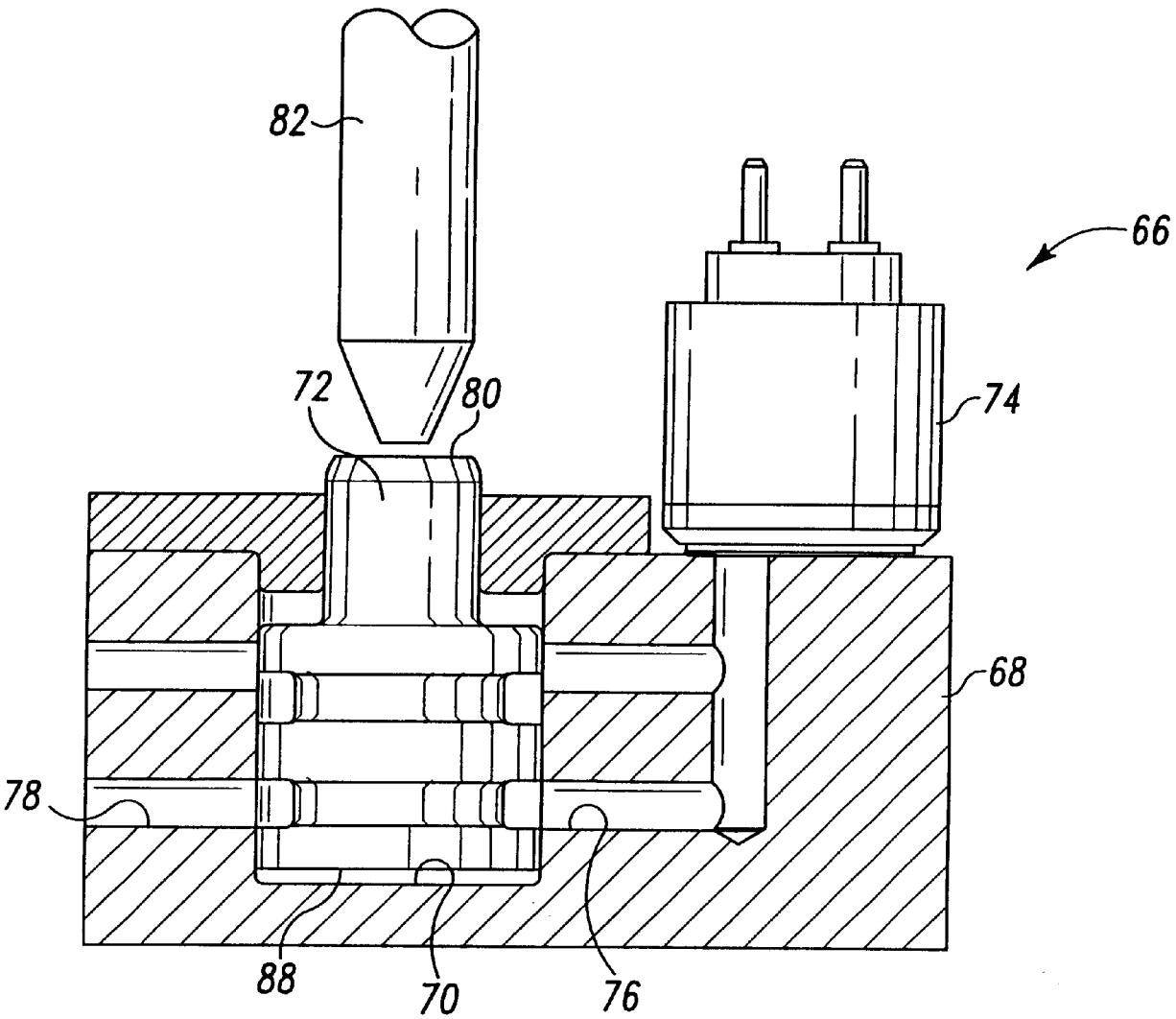
FIG. 3 is a cross sectional view of the actuator assembly of the compression release brake assembly of the internal combustion engine of FIG. 1, note that the solenoid-controlled hydraulic valve is not shown in cross section for clarity of description.

The engine 10 also includes a hydraulically-powered compression release brake assembly 64. The compression release brake assembly 64 includes a number of actuator assemblies 66 (see also FIG. 3) which are provided to selectively open the exhaust valves 42 associated with the engine 10 when the engine 10 is being operated in a brake mode of operation. Each of the actuator assemblies 66 includes a housing 68 having a fluid chamber 70 defined therein for housing a piston 72. Each of the actuator assemblies 66 also includes a high-speed, solenoid-actuated hydraulic valve 74. The solenoid-actuated hydraulic valves 74 are similar to the solenoid-actuated hydraulic valves 58. For example, one high-speed, solenoid-actuated hydraulic valve which may be utilized as the solenoid-actuated hydraulic valves 74 of the present invention are the solenoid-actuated hydraulic valves which are utilized to actuate the fuel injectors of the above-noted HEUI fuel injection system. Such solenoid-actuated hydraulic valves are likewise commercially available from Caterpillar.

The housing 68 of the actuator assembly 66 has a number of input fluid passages 76 and drain fluid passages 78 defined therein. The solenoid-actuated hydraulic valve 74 selectively couples the input fluid passages 76 to the fluid manifold 48. In particular, when the solenoid-actuated hydraulic valve 74 is positioned in an open position, pressurized hydraulic fluid is advanced from the fluid manifold 48, into an input port associated with the valve 74, out an output port associated with the valve 74, and into the input fluid passages 76 and hence the fluid chamber 70. The presence of pressurized hydraulic fluid in the fluid chamber 70 causes the piston 72 to be urged upwardly (as viewed in FIG. 3) and into an extended position in which a contact side 80 of the piston 72 is urged into contact with a portion of the exhaust rocker arm 20.

Figure 4:
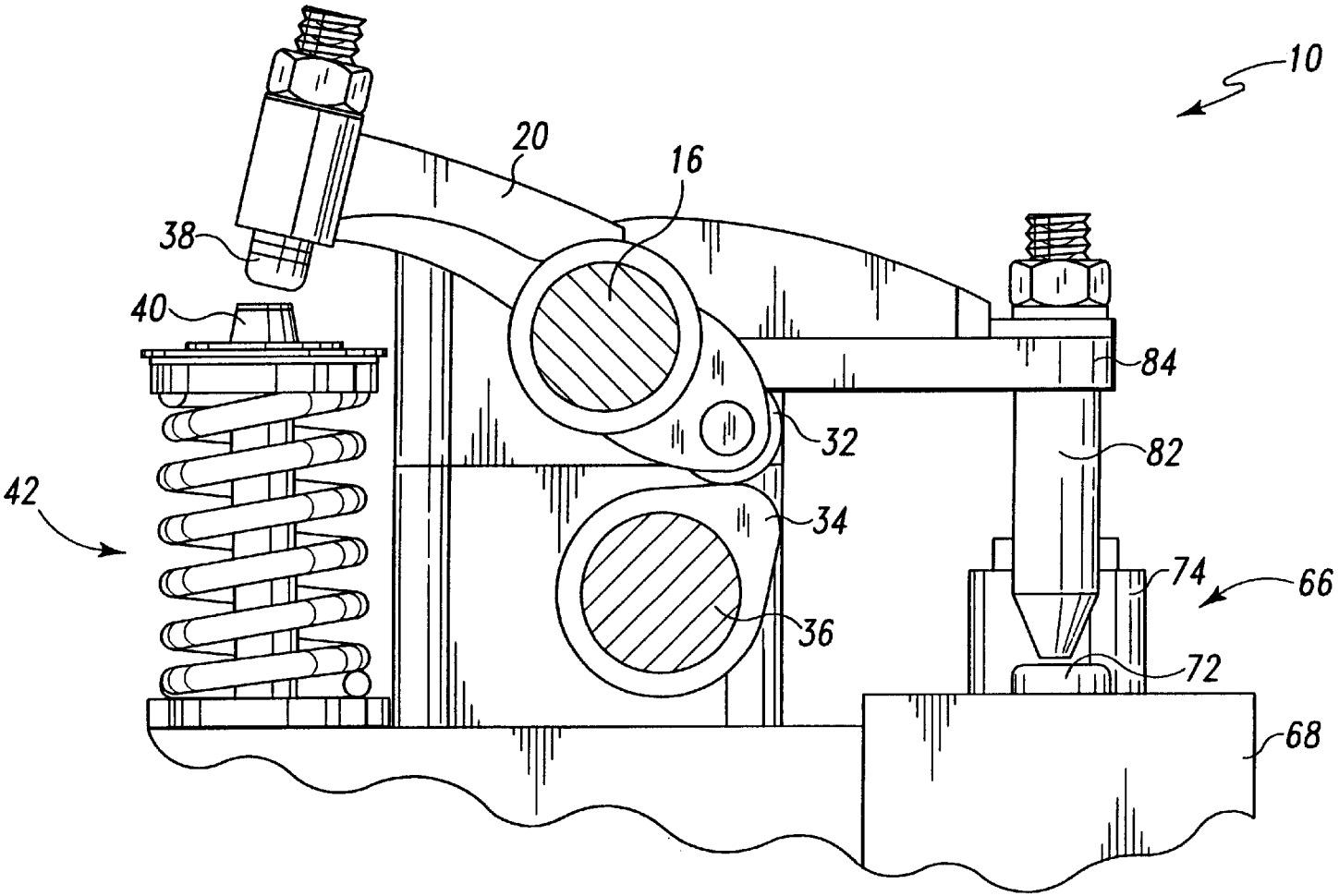
FIG. 4 is a side elevational view which shows the actuator assembly of the compression release brake assembly of FIG. 3 being utilized in the design of an overhead cam engine.

In particular, as shown in FIG. 4, a contact rod 82 is secured to an extension member 84 of each of the exhaust rocker arms 20. When the contact rod 82 is contacted by the piston 72, the contact rod 82 is urged upwardly (as viewed in FIG. 4) so as to urge the extension member 84 of the exhaust rocker arm 84 upwardly. Movement of the extension member 84 in an upward direction (as viewed in FIGS. 3 and 4) causes the exhaust rocker arm 20 to pivot or otherwise rotate about the rocker arm shaft 16 thereby causing the valve contact rod 38 associated with the exhaust rocker arm 20 to contact the upper portion of a valve stem 40 of the exhaust valve 42. Such contact with the upper portion of the valve stem 40 urges the exhaust valve 42 downwardly thereby opening the exhaust valve 42 so as to allow gas within the associated engine cylinder to flow from the cylinder.

It should be appreciated that operation of the actuator assemblies 66 is under the control of the engine control module 60. In particular, each of the solenoid-actuated hydraulic valves 74 is coupled to the engine control module 60 via a wiring harness 86. In such a manner, the engine control module 60 may selectively generate pulses which are sent to the individual solenoid-actuated hydraulic valves 74 so as to open the valve 74 thereby causing pressurized hydraulic fluid to be advanced from the fluid manifold 48 to a fluid side 88 of the piston 72 so as to urge the piston 72 upwardly (as viewed in FIG. 3). Such upward movement of the piston 72 causes rotation of the exhaust rocker arm 20 and hence opening of the exhaust valve 42 thereby allowing gas to be advanced out the associated engine cylinder. Once the exhaust valve has been opened for a predetermined period of time, the engine control module 60 ceases to generate a pulse on the wiring harness 86 thereby causing the particular exhaust valve 42 to be closed.

It should be appreciated that the stroke length of the piston 72 is predetermined in order to prevent the exhaust valve 42 from being opened by an amount which could potentially allow the exhaust valve 42 to be contacted by the engine's pistons within the respective engine cylinders. Also, as shown in FIG. 4, there is a gap of a predetermined distance between the contact side 80 of the piston 72 and the lower surface of the contact rod 82 in order to prevent the exhaust valve 84 from being inadvertently held open during operation of the engine 10 which could potentially reduce the useful life of the exhaust valve 42.

It should also be appreciated that the engine control module 60 controls operation of the fuel injectors 46 and the brake actuator assemblies 66 in order to control output from the engine 10. In particular, the engine 10 is operable in either a drive mode of operation or a brake mode of operation. When the engine 10 is being operated in its drive mode of operation, the engine control module 60 controls the fuel injectors 46 such that fuel is injected into the engine cylinders so as to cause combustion within the engine cylinders in order to produce positive mechanical output from the engine 10 thereby driving the drive train (not shown) of a work machine such as an on-highway truck. It should be noted that when the engine 10 is being operated in its drive mode of operation, the intake valves 30 and the exhaust valves 42 are operated in a known manner (i.e. selectively opened and closed) by the camshafts 24, 36, respectively, such that the intake valves 30 are opened during the intake stroke of the engine 10, whereas the exhaust valves 42 are opened during the exhaust stroke of the engine 10.

Moreover, when the engine 10 is operated in its drive mode of operation, the compression release brake assembly 64 is idled. In particular, during operation of the engine 10 in its drive mode of operation, the engine control module does not open any of the solenoid-controlled hydraulic valves 74 associated with actuator assemblies 66 thereby isolating the fluid chamber 70 from the fluid manifold 48. Such isolation of the fluid chamber 70 from the fluid manifold 48 positions the piston 72 in its retracted position thereby preventing it from contacting the contact rod 82.

Conversely, when the engine 10 is being operated in its brake mode of operation, the engine control module 60 controls the actuator assemblies 66 of the compression release brake assembly 64 such that the exhaust valves 42 are selectively opened in order to release compressed gas within the engine cylinders. In particular, near the end of the compression stroke, the engine control module 60 generates an output pulse which opens the solenoid-controlled valve 74 of a particular actuator assembly 66 thereby causing the piston 72 to urge the contact rod 82 upwardly which in turn opens the exhaust valve 42 in the manner described above.

Moreover, when the engine 10 is operated in its brake mode of operation, the fuel injection assembly 44 is idled. In particular, during operation of the engine 10 in its brake mode of operation, the engine control module 60 does not open any of the solenoid-controlled hydraulic valves 58 associated with the fuel injectors 46 thereby preventing fuel from being injected into the corresponding engine cylinders.

Industrial Applicability

In operation, the engine 10 of the present invention may be utilized to provide motive power to a work machine such as an on-highway truck or an off-highway work machine. The engine 10 is operated in its drive mode of operation in order to advance the truck. When the engine 10 is operated in its drive mode of operation, the engine control module 60 operates the fuel injectors 46 such that fuel is injected into the engine cylinders so as to cause combustion within the engine cylinders.

In particular, the engine control module 60 selectively generates injection pulses on the wiring harness 62 which are communicated to each of the various solenoid-controlled hydraulic valves 58 associated with the fuel injectors 46. Upon receipt of the injection pulse from the engine control module 60, the respective solenoid-controlled hydraulic valves 58 are opened thereby causing fuel to be injected into the corresponding engine cylinder of the engine 10. In particular, when one of the solenoid-controlled hydraulic valves 58 is opened by the engine control module 60, pressurized hydraulic fluid from the fluid manifold 48 is advanced into the fuel injector 46 so as to increase the fluid pressure exerted on the plunger assembly (not shown) of the associated fuel injector 46 which in turn increases the fuel pressure within the injector 46. Such an increase in the fuel pressure within the fuel injector 46 causes fuel to be injected into the engine cylinder associated with the particular fuel injector 46. In such a manner, positive mechanical output from the engine 10 is transmitted to the drive train (not shown) of the truck thereby providing the operative power to advance the truck. It should be appreciated that when the engine 10 is being operated in its drive mode of operation, the intake valves 30 and the exhaust valves 42 are operated in a known manner (i.e. selectively opened and closed) by the camshafts 24, 36, respectively, such that the intake valves 30 are opened during the intake stroke of the engine 10, whereas the exhaust valves 42 are opened during the exhaust stroke of the engine 10.

Moreover, when the engine 10 is operated in its drive mode of operation, the compression release brake assembly 64 is idled. In particular, during operation of the engine 10 in its drive mode of operation, the engine control module 60 does not open any of the solenoid-controlled hydraulic valves 74 associated with actuator assemblies 66 thereby isolating the fluid chamber 70 from the fluid manifold 48. Such isolation of the fluid chamber 70 from the fluid manifold 48 positions the piston 72 in its retracted position thereby preventing it from contacting the contact rod 82.

However, during heavy braking of the truck, such as downhill braking or the like, the operator of the truck (or the engine control module 60 itself) may switch the engine 10 into its brake mode of operation in order to assist the truck's main braking system in the slowing of the truck. When the engine 10 is being operated in its brake mode of operation, the engine control module 60 controls operation of the actuator assemblies 66 of the compression release brake assembly 64 such that the exhaust valves 42 are selectively opened in order to release compressed gas within the engine cylinders. In particular, near the end of the compression stroke of a particular engine piston, the engine control module 60 generates an output pulse which opens the solenoid-controlled hydraulic valve 74 of the actuator assembly 66 associated with the particular piston/engine cylinder. Opening of the solenoid-controlled hydraulic valve 74 allows pressurized hydraulic fluid from the fluid manifold 48 to be advanced through the solenoid-controlled hydraulic valve 74 and into the fluid chamber 70 of the actuator assembly 66. The presence of pressurized hydraulic fluid in the fluid chamber 70 causes the piston 72 to be urged upwardly (as viewed in FIG. 3) into an extended position in which the contact side 80 of the piston 72 is urged into contact with a portion of the exhaust rocker arm 20.

In particular, as shown in FIG. 4, when the contact rod 82 is contacted by the piston 72, the contact rod 82 is urged upwardly (as viewed in FIG. 4) so as to urge the extension member 84 of the exhaust rocker arm 84 upwardly. Movement of the extension member 84 in an upward direction (as viewed in FIGS. 3 and 4) causes the exhaust rocker arm 20 to pivot or otherwise rotate about the rocker arm shaft 16 thereby causing the valve contact rod 38 associated with the exhaust rocker arm 20 to be urged downwardly and into contact with the upper portion of the valve stem 40 of the exhaust valve 42. Such contact with the upper portion of the valve stem 40 urges the exhaust valve 42 downwardly thereby opening the exhaust valve 42 so as to allow gas within the associated engine cylinder to flow from the engine cylinder.

Moreover, when the engine 10 is operated in its brake mode of operation, the fuel injection assembly 44 is idled. In particular, during operation of the engine 10 in its brake mode of operation, the engine control module 60 does not open any of the solenoid-controlled hydraulic valves 58 associated with the fuel injectors 46 thereby preventing fuel from being injected into the corresponding engine cylinders.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

Figure 5:
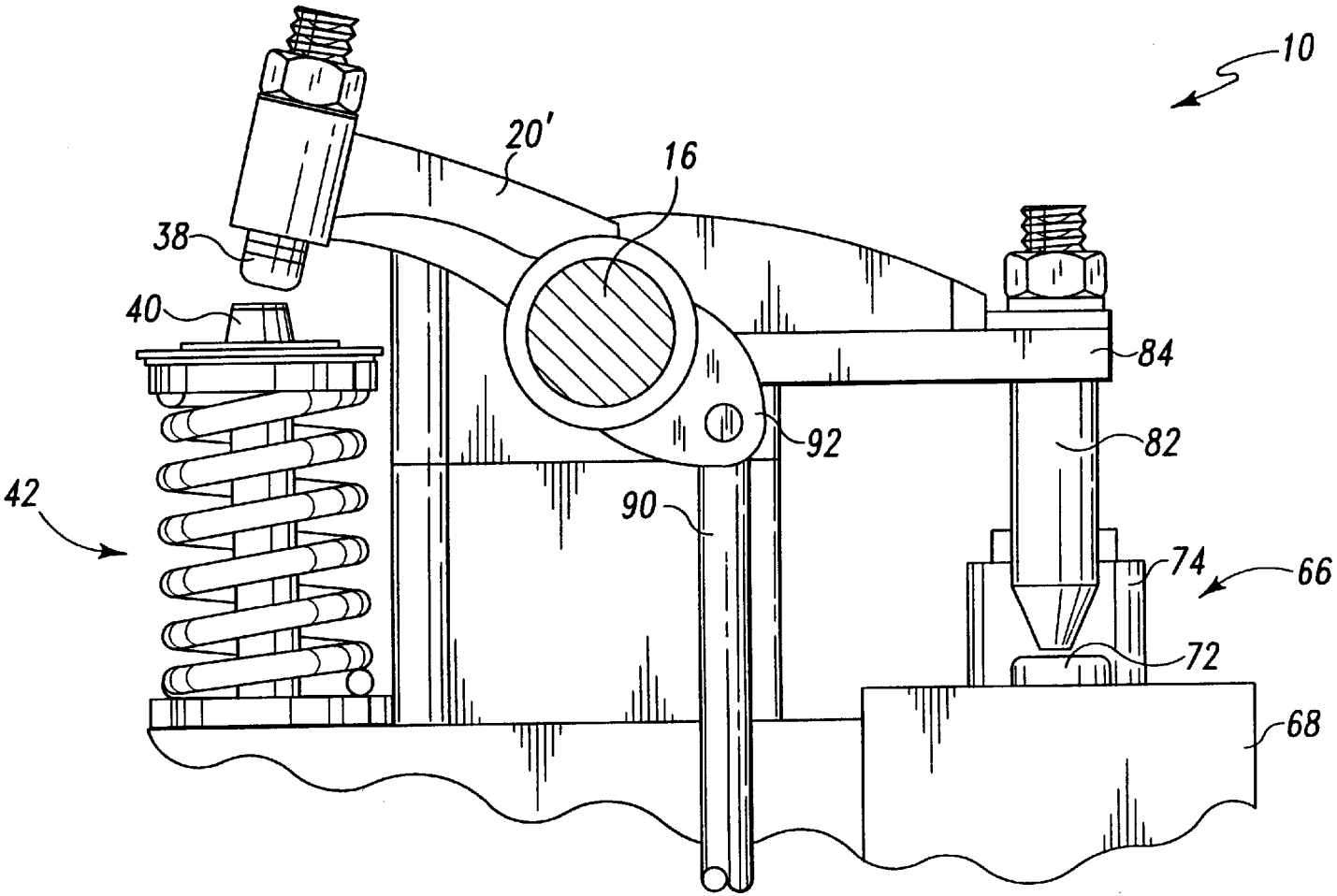
FIG. 5 is a view similar to FIG. 4, but showing the actuator assembly of the compression release brake assembly being utilized in the design of a push rod engine.

For example as shown in FIG. 5, the concepts of the present invention may be utilized in conjunction with a push rod engine 10'. In such a configuration, a push rod 90 is coupled to an end portion 92 of an exhaust rocker arms 20' such that the exhaust rocker arm 20' is rotated about the rocker arm shaft 16 when the push rod 90 urges the end portion 92 of the rocker arm 20' upwardly. In such a configuration, the actuator assemblies 66 would likewise be utilized to selectively urge the exhaust rocker arms 20' upwardly so as to selectively open the respective exhaust valves 42 when the engine 10' is being operated in its brake mode of operation.

There are a plurality of advantages of the present invention arising from the various features of the compression release brake assembly described herein. It will be noted that alternative embodiments of the compression release brake assembly of the present invention may not include all of the features described yet still benefit from at least some of the advantages of such features. Those of ordinary skill in the art may readily devise their own implementations of a compression release brake assembly that incorporate one or more of the features of the present invention and fall within the spirit and scope of the present invention as defined by the appended claims.

What is claimed is:

1. A method of operating an internal combustion engine having (i) a hydraulic supply circuit, (ii) a hydraulically-powered fuel injector assembly, (iii) a hydraulically-powered compression release brake assembly having (A) a first piston mechanically coupled to a first exhaust valve associated with said internal combustion engine and (B) a second piston mechanically coupled to a second exhaust valve associated with said internal combustion engine, and (iv) an engine control module electrically coupled to said hydraulically-powered fuel injector assembly and said hydraulically-powered compression release brake assembly, comprising the steps of:

advancing a pressurized hydraulic fluid to said fuel injector assembly from said hydraulic supply circuit in response to an injection pulse generated by said engine control module so as to cause fuel to be injected into a cylinder associated with said engine when said engine is being operated in a drive mode of operation;

advancing said pressurized hydraulic fluid to said compression release brake assembly from said hydraulic supply circuit in response to a brake pulse generated by said engine control module so as to selectively cause said first piston to be moved from a retracted position to an extended position when said engine is being operated in a brake mode of operation while said second piston remains in a retracted position; and rotating a rocker arm about a rocker arm shaft so as to cause said rocker arm to contact said first exhaust valve thereby urging said first exhaust valve into an open exhaust valve position in response to movement of said first piston from said retracted position to said extended position.

2. The method of claim 1, wherein said step of advancing said pressurized hydraulic fluid to said compression release brake assembly includes the step of exerting hydraulic pressure onto a first side of said first piston so as to urge a second side of said first piston into contact with said rocker arm.

3. The method of claim 1, further including the step of:

advancing a cam lobe of a camshaft into contact with said rocker arm so as to cause said rocker arm to rotate about said rocker arm shaft and into contact with said first exhaust valve thereby urging said first exhaust valve into said open exhaust valve position when said engine is being operated in said drive mode of operation.

4. The method of claim 1, further including the step of:

urging said rocker arm with a push rod so as to cause said rocker arm to rotate about said rocker arm shaft and into contact with said first exhaust valve thereby urging said first exhaust valve into said open exhaust valve position when said engine is being operated in said drive mode of operation.

5. The method of claim 1, wherein:

said first exhaust valve includes a valve stem, and said step of advancing said pressurized hydraulic fluid to said compression release brake assembly includes the step of urging said first piston into contact with a first portion of said rocker arm so as to cause a second portion of said rocker arm to be urged into contact with said valve stem of said first exhaust valve.

6. The method of claim 1, wherein:

said hydraulic supply circuit includes a hydraulic pump, said compression release brake assembly includes a hydraulic valve having an open hydraulic valve position and a closed hydraulic valve position, an input port of said hydraulic valve is fluidly coupled to said hydraulic pump, an output port of said hydraulic valve is fluidly coupled to a fluid chamber which houses said first piston, said hydraulic valve allows said pressurized hydraulic fluid to be advanced from said hydraulic pump to said fluid chamber when said hydraulic valve is positioned in said open hydraulic valve position, said hydraulic valve prevents said pressurized hydraulic fluid from being advanced from said hydraulic pump to said fluid chamber when said hydraulic valve is positioned in said closed hydraulic valve position, and said step of advancing said pressurized hydraulic fluid to said compression release brake assembly includes the step of positioning said hydraulic valve into said open hydraulic valve position.

7. The method of claim 6, wherein said step of advancing said pressurized hydraulic fluid to said fuel injector assembly includes the step of positioning said hydraulic valve into said closed hydraulic valve position.

8. The method of claim 6, wherein said step of advancing said pressurized hydraulic fluid to said compression release brake assembly includes the step of isolating said fuel injector assembly from said hydraulic pump so as to prevent said fuel from being injected into said cylinder.

9. An internal combustion engine, comprising:

an engine block having a first cylinder defined therein and a second cylinder defined therein;

a first exhaust valve movably secured to said engine block and associated with said first cylinder;

a second exhaust valve movably secured to said engine block and associated with said second cylinder;

a rocker arm shaft secured to said engine block;

a rocker arm rotatably coupled to rocker arm shaft;

a hydraulically-powered fuel injector assembly secured to said engine block so as to selectively inject fuel into said first cylinder or said second cylinder;

a hydraulically-powered compression release brake assembly having (i) a first piston mechanically coupled to said first exhaust valve and (ii) a second piston mechanically coupled to said second exhaust valve;

an engine control module electrically coupled to said hydraulically-powered fuel injector assembly and said hydraulically-powered compression brake assembly; and a hydraulic supply circuit fluidly coupled to both said fuel injector assembly and said compression brake assembly, wherein (i) said hydraulic supply circuit is configured to advance a pressurized hydraulic fluid to said fuel injector assembly in response to an injection pulse generated by said engine control module so as to cause said fuel to be injected into said first cylinder when said engine is being operated in a drive mode of operation, (ii) said hydraulic circuit is further configured to advance said pressurized hydraulic fluid to said compression release brake assembly in response to a brake pulse generated by said engine control module so as to selectively cause said first piston to be moved from a retracted position to an extended position when said engine is being operated in a brake mode of operation while said second piston remains in a retracted position, and (iii) said rocker arm is rotated about said rocker arm shaft so as to cause said rocker arm to contact said first exhaust valve thereby urging said first exhaust valve into an open exhaust valve position when said first piston is moved from said retracted position to said extended position.

10. The engine of claim 9, wherein hydraulic pressure is exerted onto a first side of said first piston so as to urge a second side of said first piston into contact with said rocker arm when said engine is being operated in said brake mode of operation.

11. The engine of claim 9, further including a cam shaft having a cam lobe secured thereto, wherein said cam lobe is advanced into contact with said rocker arm so as to cause said rocker arm to rotate about said rocker arm shaft and into contact with said first exhaust valve thereby urging said first exhaust valve into said open exhaust valve position when said engine is being operated in said drive mode of operation.

12. The engine of claim 9, further including a push rod coupled to said rocker arm, wherein said push rod urges said rocker arm so as to cause said rocker arm to rotate about said rocker arm shaft and into contact with said first exhaust valve thereby urging said first exhaust valve into said open exhaust valve position when said engine is being operated in said drive mode of operation.

13. The engine of claim 9, wherein:

said first exhaust valve includes a valve stem, and said piston is urged into contact with a first portion of said rocker arm so as to cause a second portion of said rocker arm to be urged into contact with said valve stem of said first exhaust valve when said engine is being operated in said brake mode of operation.

14. The engine of claim 9, wherein:

said hydraulic supply circuit includes a hydraulic pump, said compression release brake assembly includes a hydraulic valve having an open hydraulic valve position and a closed hydraulic valve position, an input port of said hydraulic valve is fluidly coupled to said hydraulic pump, an output port of said hydraulic valve is fluidly coupled to a fluid chamber which houses said first piston, said hydraulic valve allows said pressurized hydraulic fluid to be advanced from said hydraulic pump to said fluid chamber when said hydraulic valve is positioned in said open hydraulic valve position, said hydraulic valve prevents said pressurized hydraulic fluid from being advanced from said hydraulic pump to said fluid chamber when said hydraulic valve is positioned in said closed hydraulic valve position, and said hydraulic valve is selectively positioned in said open hydraulic valve position when said engine is being operated in said brake mode of operation.

15. The engine of claim 14, wherein said hydraulic valve is positioned in said closed hydraulic valve position when said engine is being operated in said drive mode of operation.

16. The engine of claim 14, wherein said fuel injector assembly is isolated from said hydraulic pump so as to prevent said fuel from being injected into said cylinder when said engine is being operated in a brake mode of operation.

* * * * *